US007249446B1

(12) United States Patent
Hapner

(10) Patent No.: US 7,249,446 B1
(45) Date of Patent: Jul. 31, 2007

(54) STIRRUP HANGER FOR SADDLE

(76) Inventor: Rodney J. Hapner, 13622 S. 215th W. Ave., Sapulpa, OK (US) 74066

( * ) Notice: Subject to any disclaimer, the term of this patent is extended or adjusted under 35 U.S.C. 154(b) by 482 days.

(21) Appl. No.: 11/011,831

(22) Filed: Dec. 14, 2004

(51) Int. Cl.
*B68C 1/16* (2006.01)

(52) U.S. Cl. ..... 54/46.1

(58) Field of Classification Search ..... 54/44.1, 54/46.1, 46.2
See application file for complete search history.

(56) References Cited

U.S. PATENT DOCUMENTS

| | | | | |
|---|---|---|---|---|
| 1,279,051 | A * | 9/1918 | Webb | 54/46.1 |
| 2,624,167 | A * | 1/1953 | Diaz | 54/46.1 |
| 2,730,853 | A * | 1/1956 | Manning | 54/46.1 |
| 2,845,766 | A * | 8/1958 | Leddy | 54/46.1 |
| 3,096,552 | A | 7/1963 | Kreger, Jr. | |
| 3,312,040 | A | 4/1967 | Nuzzo | |
| 3,978,644 | A | 9/1976 | Hillman | |
| 4,782,649 | A | 11/1988 | Zubrod | |
| 4,924,660 | A | 5/1990 | Norman et al. | |
| 5,018,340 | A | 5/1991 | Marshall | |
| 6,116,003 | A * | 9/2000 | Ziglin | 54/23 |
| 6,453,653 | B2 | 9/2002 | Grönberg | |
| 6,688,087 | B2 | 2/2004 | DeCosemo | |

* cited by examiner

*Primary Examiner*—Rob Swiatek
(74) *Attorney, Agent, or Firm*—Molly D. McKay

(57) ABSTRACT

A stirrup hanger for saddle consisting of a short strip and a long strip secured together with a swivel mechanism that allows the stirrups to move forward and rearward freely. A metal plate having a hole there through secured on each end of the short piece. A t-nut secured to one of the metal plates in alignment with its hole. A third metal plate with a nylon bushing there through secured on one end of the long strip and a stirrup secured to the opposite end. The short piece of leather is looped through the saddle tree bar and then a bolt is inserted consecutively through the hole in the second plate, the nylon bushing and the hole in the first plate. The bolt is then threaded into the t-nut to secure the third metal plate in pivoting fashion between the first and second metal plates.

9 Claims, 3 Drawing Sheets

STIRRUP HANGER FOR SADDLE

BACKGROUND OF THE INVENTION

1. Field of the Invention

The present invention relates to a stirrup hanger for hanging a stirrup on a riding saddle.

2. Description of the Related Art

Current stirrup hangers are a simply a strap of leather that loops over a stationary saddle tree bar provided on the saddle as a part of the framework for the saddle on an upper end of the hanger and that extend downward and loop through a stirrup on the lower end of the hanger. Each of the stirrup leather straps is between 1½ to 3 inches wide and at least ¼ inch thick. Each stirrup leather strap loops around one of the saddle tree bars i.e., the two bars that connect the cantle or back of the saddle tree to the fork or front of the saddle tree to form the framework for the saddle. The saddle tree bar does not move relative to the saddle and with the saddle on the horse and the rider in the saddle, this puts weight on the part of the stirrup hanger that is on the bottom side of the saddletree bar thereby restricting the movement of the upper end of the hanger. Because the upper end of the hanger is restricted in its movement relative to the saddle, when the rider attempts to stop quickly, the stirrups move forward thereby causing wrinkling of the stirrup hanger. The stirrup hanger wrinkles at both the fender and at the upper end of the hanger.

When the fender wrinkles, this forces the rider's legs to spread out and prevents the rider from maintaining a tight leg grip on his horse. Without a tight leg grip on his horse, the rider can not brace himself in the stirrups with his feet as the horse stops as well as he normally would be able to and can thus be thrown over the horse's head as the horse is stopping. Not only is this situation dangerous for the rider, the horse can also be injured when the rider is not able to hold himself securely in the saddle and the horse experiences an unexpected shift in his rider's weight as the horse is attempting to stop.

When the upper end of the hanger wrinkles, the leather which is bent around a tight radius at the saddle tree bar will eventually crack and break. Leather failure in the traditional loop stirrup leather caused by frequent wrinkling and bending of the leather can be very dangerous for the rider.

Some saddle makers use D-ring rigging in the skirt of the saddle or in-skirt rigging to help give more stirrup swing forward and backward without as much wrinkling of the leather. However, this type of rigging is not totally satisfactorily and does not provide the amount of swing desired.

The present invention addresses this problem by providing a stirrup hanger for a saddle that attaches around the stationary bar and provides a swivel that allows the stirrup leather to pivot near the bar. This allows the stirrup leather to pivot and the stirrups to move forward on the horse as the horse stops instead of having the fender wrinkle outward as the stirrups move forward. Because the stirrup leather is allowed to pivot relative to the saddle without wrinkling the fender, the rider's legs are free to move forward in the stirrups and the rider is able to maintain tight leg contract with the horse as the horse stops. This allows the rider to brace himself in the saddle better which results in a safer situation for both the horse and the rider.

Further, the present stirrup hanger swivels in both the forward and rearward direction. This puts less strain on the rider's knee, hip and ankle joints. The present invention also greatly improves the rider's balance when riding downhill because the rider is able to swing the stirrups forward.

Likewise, the present invention improves the rider's balance when riding uphill because the rider is able to swing the stirrups backward.

The present invention addresses this problem by providing metal plates riveted on each end of a short piece of leather. The short piece of leather is then looped through the saddle tree bar. A first metal plate has a hole in it and a t-nut inserted through the hole and spot welded in place. The second metal plate has a hole in it that is slightly larger than the small end of the t-nut.

Another long strip of leather is provided on one end with a third metal plate rivet to it and provided on an opposite end with a stirrup attached to the second end. The third metal plate is provided with a nylon bushing in it. Once the short piece of leather has been looped through the saddle tree bar, a bolt is inserted through the hole in the second metal plate, then through the nylon bushing of the third metal plate and finally threads into the nut provided attached to the first metal plate. In this way the long strip of leather that has the stirrup attached to it is pivotally attached to the saddle in such a way that the stirrup is free to move forward and backward on the saddle without wrinkling the stirrup leather of either the short piece of leather or the long piece of leather. The nylon bushing can also be replaced if it becomes worn. However, this device will last for many years without any service at all. Because the plates are made of metal, the device is much safer because there is little chance that the device will fail and result in loss of a stirrup while in use.

Further, the present invention will fit any saddle where the stirrup leather goes around the tree bars.

SUMMARY OF THE INVENTION

The present invention is a stirrup hanger for hanging a stirrup on a riding saddle that allows the stirrups to move forward and rearward freely relative to the saddle without wrinkling the stirrup leather. The present stirrup hanger attaches around the stationary saddle tree bar and provides a swivel that allows the stirrup leather to pivot near the bar. This allows the rider to better maintain his balance with less strain on the rider's joints.

The invention consists of a short piece of leather and a long strip of leather. A metal plate is riveted on each end of a short piece of leather. The short piece of leather is then looped through the saddle tree bar. The first metal plate has a hole in it and a t-nut inserted through the hole and spot welded in place. The second metal plate has a hole in it that is slightly larger than the small end of the t-nut.

The long strip of leather is provided on an upper end with a third metal plate rivet to it and provided on an opposite lower end with a stirrup attached to it. The third metal plate is provided with a nylon bushing in it.

Once the short piece of leather has been looped through the saddle tree bar, a bolt is inserted through the hole in the second metal plate, then through the nylon bushing of the third metal plate and finally through the hole in the first metal plate. The bolt is then threaded into the nut provided attached to the first metal plate to secure the third metal plate in pivoting fashion between the first and second metal plates. In this way the long strip of leather that has the stirrup attached to it is pivotally attached to the saddle in such a way that the stirrup is free to move forward and backward on the saddle without wrinkling the stirrup leather of either the short piece of leather or the long piece of leather.

The nylon bushing can be replaced if it becomes worn. However, this device will last for many years without any service at all. Because the plates are made of metal, the device is much safer because there is little chance that the device will fail and result in loss of a stirrup while in use.

DETAILED DESCRIPTION OF THE PREFERRED EMBODIMENT THE INVENTION

Figure 1:
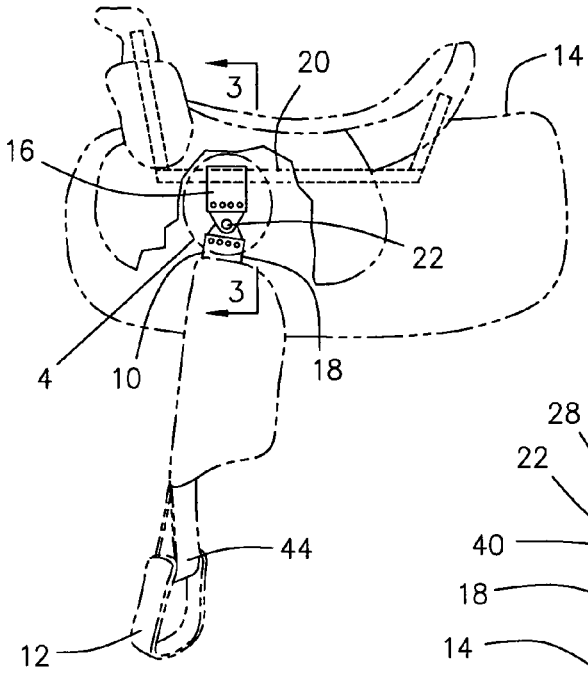
FIG. 1 is a side view of a stirrup hanger for saddle constructed in accordance with a preferred embodiment of the present invention, shown installed on a saddle.
Figure 2:
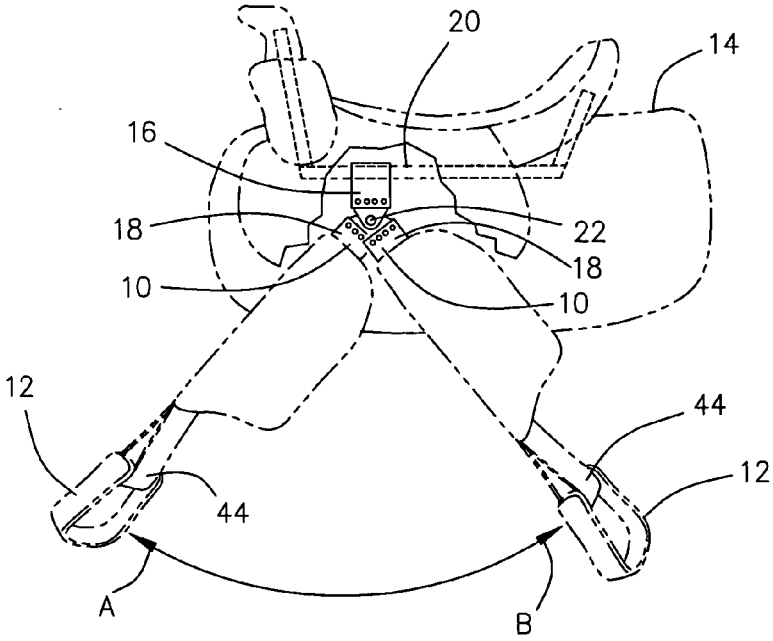
FIG. 2 is the stirrup hanger for saddle of FIG. 1 showing the forward and rearward swing of the stirrup afforded by the present invention.

Referring now to the drawings and initially to FIGS. 1 and 2, there is illustrated a stirrup hanger 10 for a saddle 14 that is constructed in accordance with a preferred embodiment of the present invention. As illustrated in FIG. 2, the stirrup hanger 10 is designed to hang a stirrup 12 on a riding saddle 14 so that the stirrup 12 is allowed to freely move forward, as indicated by arrow A, and rearward, as indicated by arrow B, relative to the saddle 14 without wrinkling the two pieces or strips of stirrup leather 16 and 18 comprising the stirrup hanger 10.

Figure 7:
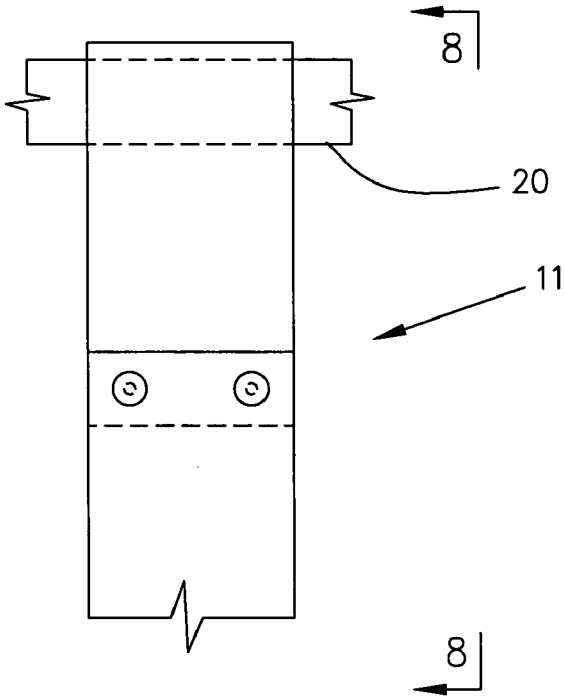
Fig. 7 (PRIOR ART)
FIG. 7 is a prior art stirrup hanger similar to the view of FIG. 4.
Figure 8:
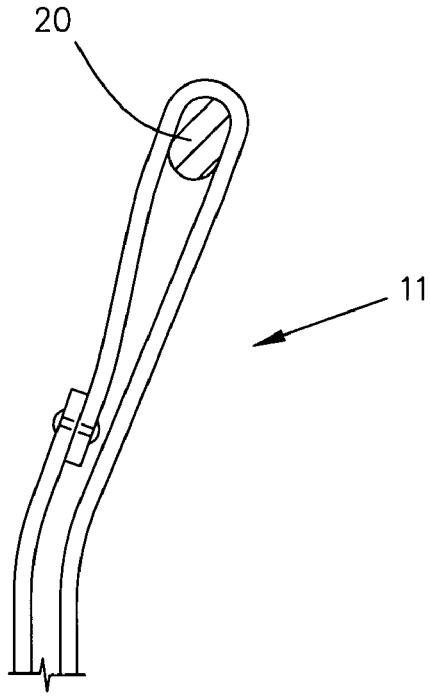
Fig. 8 (PRIOR ART)
FIG. 8 is a rear view of a prior art stirrup hanger taken along line 8-8 of FIG. 7 and is a view similar to that shown in FIG. 5.

Referring to FIGS. 7 and 8, there is illustrated a one piece, prior art stirrup hanger 11 that is shown attached around a stationary saddle tree bar 20 of a saddle and riveted together to form a continuous loop. This prior art stirrup hanger 11 does not allow a stirrup (not illustrated) which will be attached to the lower end of the prior art stirrup hanger 11 to move forward or rearward relative to the saddle in the manner illustrated in FIG. 2 for the present invention 10 without wrinkling the leather from which the prior art stirrup hanger 11 is constructed.

Figure 3:
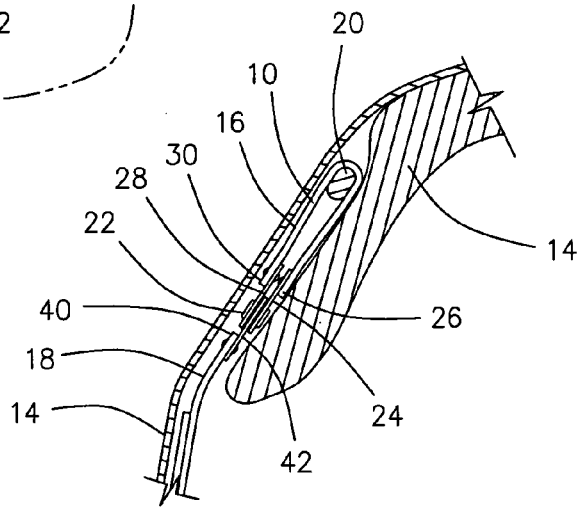
FIG. 3 is a cross sectional view taken along line 3-3 of FIG. 1.

As shown in FIGS. 2 and 3, the short piece of stirrup leather 16 of the present stirrup hanger 10 attaches around the stationary saddle tree bar 20 of the saddle 14 and a swivel mechanism 22 provided at the junction of the short and long pieces 16 and 18 allows the long piece of stirrup leather 18 to pivot near the bar 20. This allows the rider to keep a tight leg grip on the horse and better maintain his balance in the saddle 14 with less strain on the rider's joints. The swivel mechanism 22 consists of three metal plates 24, 28 and 42 secured together with a bolt 48 and t-nut 34, as will be more fully described hereafter.

Figure 4:
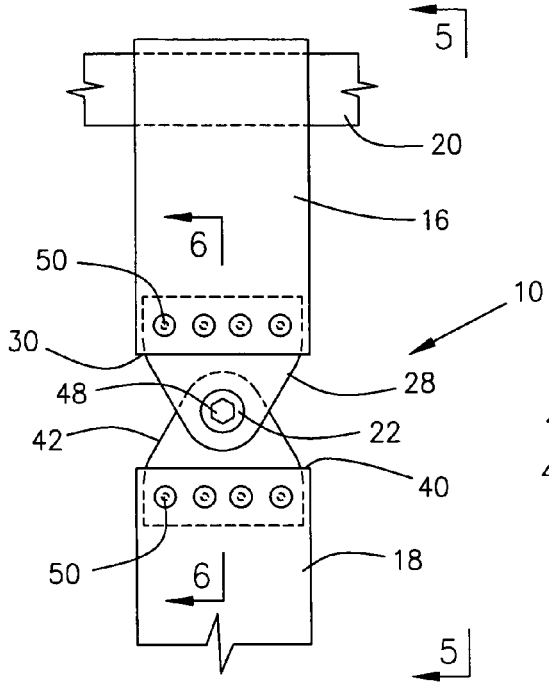
FIG. 4 is an enlarged view of the area within circle 4 of FIG. 1.
Figure 5:
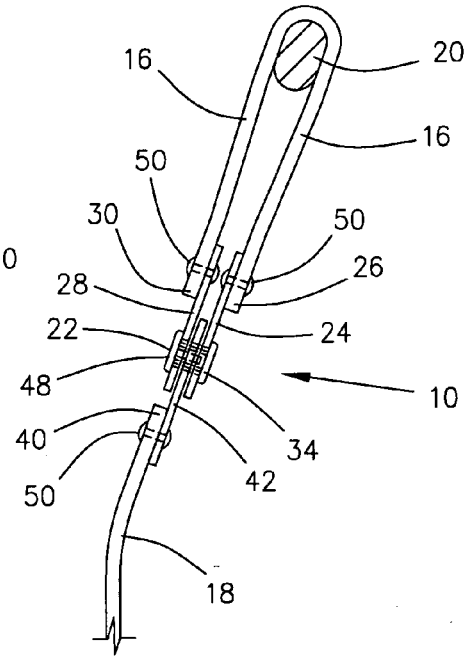
FIG. 5 is a rear view taken along line 5-5 of FIG. 4.
Figure 6:
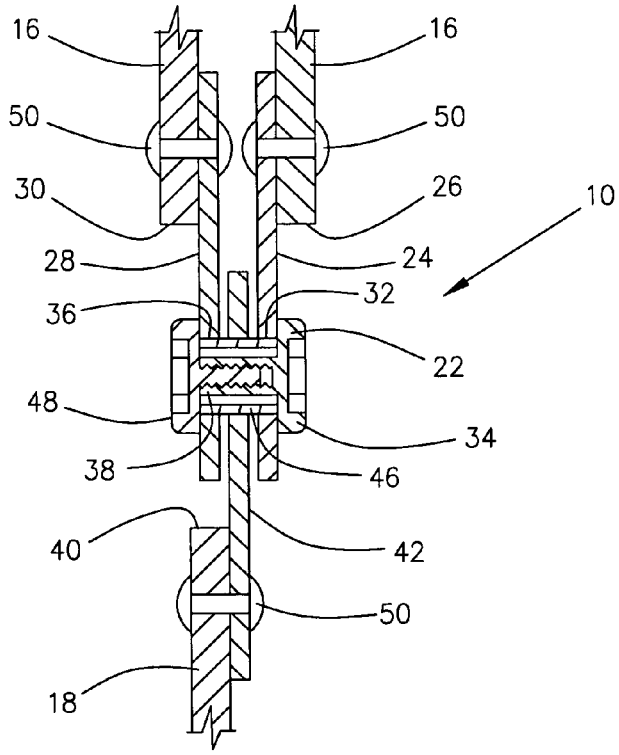
FIG. 6 is a cross sectional view taken along line 6-6 of FIG. 4.

Referring now to FIGS. 4, 5, and 6, the invention consists of the short piece of stirrup leather 16 and a long strip of leather 18. A first metal plate 24 is secured via rivets 50 on a first end 26 of the short piece of leather 16 and a second metal plate 28 is secured via rivets 50 on opposite second end 30 of the short piece of leather 16. As shown in FIG. 6, the first metal plate 24 has a hole 32 extending through it and a small end 38 of a t-nut 34 is inserted through the hole 32 and then the t-nut 34 is spot welded to the first metal plate 24 to hold the t-nut 34 in place. The second metal plate 28 also has a hole 36 extending through it. The hole 36 provided in the second metal plate 28 is slightly larger than a small end 38 of the t-nut 34.

The long strip of leather 18 is provided on its upper end 40 with a third metal plate 42 that is secured via rivets 50 to it. An opposite lower end 44 of the long strip 18 is provided with a stirrup 12 attached to it. The third metal plate 42 is provided with a nylon bushing 46 extending through it.

Referring now to FIGS. 5 and 6, to attach the stirrup hanger 10 to the saddle 14, first the short piece of leather 16 is looped around the saddle tree bar 20 so that both of the ends 26 and 30 hang downward from the bar 20. As shown in FIG. 6, once the short piece of leather 16 has thus been looped around the saddle tree bar 20, a bolt 48 is inserted consecutively through the hole 36 in the second metal plate 28, then through the nylon bushing 46 of the third metal plate 42 and finally through the hole 32 in the first metal plate 24. The bolt 48 is then threaded into the t-nut 34, thus pivotally securing the third metal plate 42 between the first and second metal plates 24 and 28. Fastened in this way to the saddle 14 via the short piece 16, the long strip of leather 18 that has the stirrup 12 attached to it is free to move forward and backward on the saddle 14 without wrinkling the leather of either the short piece 16 or long piece 18.

The nylon bushing 46 can be replaced if it becomes worn. However, this stirrup hanger 10 will last for many years without any service at all. Because the three plates 24, 28 and 42 are made of metal, the stirrup hanger 10 is stronger and safer that traditional all leather stirrup hangers and will present less risk of the hanger 10 failing and resulting in loss of a stirrup 12 while the stirrup hanger 10 is in use.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A stirrup hanger for saddle comprising:

a short piece of stirrup strap for looping around a supporting structure provided on a saddle, a first plate secured to a first end of the short piece and a second plate secured to an opposite second end of the short piece, a long piece of stirrup strap, a third plate secured to an upper end of the long piece and a stirrup secured to a lower end of the long piece, and means for pivotally securing the third plate between the first and second plates so that the long piece and the attached stirrup move freely forward and backward relative to the short piece and the third plate is between the first and second plates.

2. A stirrup hanger for saddle according to claim 1 wherein the means for pivotally securing the third plate between the first and second plates further comprises:

a bolt inserted consecutively through a hole provided in the second plate then through a bushing provided extending through the third plate and finally though a hole provided in the first plate, and a nut threaded onto the bolt in order to retain the third plate pivotally sandwiched between the first and second plates.

3. A stirrup hanger for saddle according to claim 2 wherein the bushing provided extending through the third plate is constructed of nylon.

4. A stirrup hanger for saddle according to claim 3 wherein the plates are constructed of metal and the short and long pieces are constructed of leather.

5. A stirrup hanger for saddle comprising:

a short strap with a first plate secured via rivets to a first end of the short strap and a second plate secured to an opposite second end of the short strap, a long strap with a third plate secured to an upper end of the long strap and with a stirrup secured to a lower end of the long strap, and means for pivotally securing the third plate between the first and second plates after the short strap has been looped around a supporting structure provided on a saddle, the third plate being between the first and second plates.

6. A stirrup hanger for saddle according to claim 5 wherein the means for pivotally securing the third plate between the first and second plates further comprises:

a bolt inserted consecutively through a hole provided in the second plate then through a bushing provided extending through the third plate and finally though a hole provided in the first plate, and a nut threaded onto the bolt in order to retain the third plate pivotally sandwiched between the first and second plates.

7. A stirrup hanger for saddle according to claim 6 wherein the plates are secured to the short and long straps via rivets.

8. A stirrup hanger for saddle according to claim 7 wherein the bushing provided extending through the third plate is constructed of nylon.

9. A stirrup hanger for saddle according to claim 8 wherein the plates are constructed of metal and the short and long straps are constructed of leather.

* * * * *